US011950718B2

(12) United States Patent
Vilardi

(10) Patent No.: US 11,950,718 B2
(45) Date of Patent: Apr. 9, 2024

(54) SERVING PITCHER WITH INTEGRATED CUP HOLDER

(71) Applicant: John Vilardi, Leesburg, FL (US)

(72) Inventor: John Vilardi, Leesburg, FL (US)

( * ) Notice: Subject to any disclaimer, the term of this patent is extended or adjusted under 35 U.S.C. 154(b) by 0 days.

(21) Appl. No.: 17/712,309

(22) Filed: Apr. 4, 2022

(65) Prior Publication Data

US 2022/0354287 A1 Nov. 10, 2022

Related U.S. Application Data

(60) Provisional application No. 63/186,076, filed on May 8, 2021.

(51) Int. Cl.
*A47G 19/12* (2006.01)
*A47G 23/02* (2006.01)

(52) U.S. Cl.
CPC ..... *A47G 23/0208* (2013.01); *A47G 19/12* (2013.01)

(58) Field of Classification Search
CPC ..... A47G 23/0208; A47G 19/12; B65D 21/0201; B65D 21/0202
See application file for complete search history.

(56) References Cited

U.S. PATENT DOCUMENTS 2,570,283 A * 10/1951 Stevens ..... B67D 3/00 312/351
3,331,533 A * 7/1967 Krugger ..... A47F 1/085 221/96
3,434,629 A * 3/1969 Hooge ..... A47K 5/12 222/88
3,604,592 A * 9/1971 Bacon ..... A47F 1/085 D6/527
3,861,565 A * 1/1975 Rickmeier, Jr. ..... A47G 19/12 222/131
4,889,261 A * 12/1989 Conrad ..... B65D 23/12 206/499
5,065,875 A * 11/1991 Balavich ..... B65D 21/0237 215/10
5,207,743 A 5/1993 Costarella et al.
5,301,833 A * 4/1994 Aycan ..... A47F 1/085 206/217
5,443,184 A * 8/1995 Broitzman ..... A47G 19/12 222/572
5,671,503 A * 9/1997 Uebelacker ..... B65D 21/0204 220/756

(Continued)

FOREIGN PATENT DOCUMENTS

DE 20303174 U1 * 8/2003 ..... A47G 19/12
DE 20316627 U1 * 4/2005 ..... A47G 19/12
GB 2539049 A * 12/2016 ..... A45F 3/46

*Primary Examiner* — Frederick C Nicolas

(57) ABSTRACT

A serving pitcher with an integrated cup holder. The present invention includes a pitcher having an interior volume that can hold multiple servings of beverages therein. The pitcher includes a concave cutout formed in a sidewall thereof, wherein the cutout extends from a lower side of the pitcher to an opposing upper side of the pitcher. A platform extending from the cutout at the lower side of the pitcher, wherein the platform includes a recess that can receive a cup therein. The platform is disposed within the concave cutout such that cups can be disposed on the platform in a vertically stacked configuration and supported in an upright configuration by the concave cutout.

1 Claim, 6 Drawing Sheets

(56) References Cited

U.S. PATENT DOCUMENTS

| | | | | |
|---|---|---|---|---|
| 5,853,104 | A | 12/1998 | Rathjen | |
| 6,206,218 | B1 * | 3/2001 | Young | B65D 21/0204 220/756 |
| D459,990 | S * | 7/2002 | Young | D9/530 |
| 6,427,890 | B1 * | 8/2002 | Meng | B62J 11/00 224/427 |
| 6,799,700 | B2 * | 10/2004 | Durant | A01G 25/145 222/401 |
| 6,866,166 | B2 * | 3/2005 | Mehes | A47F 1/085 222/321.7 |
| 7,011,235 | B2 * | 3/2006 | Pasquariello | A01G 25/145 222/321.7 |
| 7,216,769 | B2 | 5/2007 | Palder | |
| 7,404,497 | B2 * | 7/2008 | Lowance | B29C 51/261 220/23.4 |
| D635,459 | S * | 4/2011 | Renz | D9/530 |
| D649,057 | S * | 11/2011 | Renz | D9/516 |
| 8,100,278 | B2 * | 1/2012 | Dlouhy | B65D 23/12 215/386 |
| 8,123,069 | B1 * | 2/2012 | Mumaw | B67D 3/0061 294/142 |
| D673,855 | S * | 1/2013 | Burgeson | D9/530 |
| D692,776 | S * | 11/2013 | Burgeson | D9/453 |
| 9,572,443 | B2 | 2/2017 | Osborne | |
| 10,384,831 | B2 * | 8/2019 | Vlahakis | B65D 1/0246 |
| D978,670 | S * | 2/2023 | Poleki | D9/528 |
| 2005/0000968 | A1 * | 1/2005 | Lowance | B29C 51/261 220/500 |
| 2007/0048411 | A1 | 3/2007 | Boom et al. | |
| 2007/0175930 | A1 * | 8/2007 | Heisner | B65D 21/0237 222/530 |
| 2015/0144627 | A1 * | 5/2015 | Smith | B65D 21/0202 220/23.83 |

* cited by examiner

SERVING PITCHER WITH INTEGRATED CUP HOLDER

CROSS REFERENCE TO RELATED APPLICATION

This application claims the benefit of U.S. Provisional Application No. 63/186,076 filed on May 8, 2021. The above identified patent application is herein incorporated by reference in its entirety.

BACKGROUND OF THE INVENTION

The present invention relates to a serving pitcher. The present invention further provides a serving pitcher with an integrated cup holder for securing and transporting drinking glasses and cups thereto.

Serving a beverage from a pitcher that can contain several servings of a drink is convenient for the size and spout structure the pitcher provides to the pourer. Generally, the requirement to drinking a beverage is to have a cup or glass from which to drink the beverage. As a result, some people are left searching for cups to receive the beverage from the pitcher if they are not in a conventional location that has cups or glasses readily available. Unfortunately, the lack of availability of cups can hinder the effectiveness of the pitcher, which is more noticeable when traveling, having a picnic, or eating outside of a home or restaurant.

Furthermore, transporting serving cups or glasses with a pitcher often requires a serving tray to carry everything. Balancing glassware and a pitcher filled with liquid is cumbersome and difficult for most people. Therefore, there exists a need in the known art for a serving pitcher having a cup holder integrated with the pitcher configured to eliminate the need for a serving tray.

The present invention provides a serving pitcher for beverages that includes a storage area for individual serving containers, such as cups and glasses. This allows the individual serving containers to remain in close proximity to the pitcher at all times during transport of the beverage. The individual serving containers are configured to be easily dispensed and offered to someone.

In light of the devices disclosed in the known art, it is submitted that the present invention substantially diverges in design elements and methods from the known art and consequently it is clear that there is a need in the art for an improvement for serving pitchers with an integrated cup holder. In this regard the instant invention substantially fulfills these needs.

SUMMARY OF THE INVENTION

In view of the foregoing disadvantages inherent in the known types of serving pitchers with an integrated cup holders now present in the known art, the present invention provides a new serving pitcher with an integrated cup holder for securing and transporting drinking glasses and cups thereto.

It is an objective of the present invention to provide a serving pitcher with an integrated cup holder comprising a pitcher having an interior volume configured to retain liquid. A concave cutout is formed in a sidewall of the pitcher, wherein the cutout extends from a lower side of the pitcher to an opposing upper side of the pitcher. A platform extends from the cutout at the lower side of the pitcher, wherein the platform comprises a recess adapted to receive a cup therein.

It is an objective of the present invention to provide a serving pitcher with an integrated cup holder wherein the pitcher comprises a spout and a handle extending from an opposing side of the spout. A gap is disposed between the sidewall of the pitcher and the handle, such that the gap is configured to receive a hand of a user therein.

It is also an objective of the present invention to provide a serving pitcher with an integrated cup holder having a lid adapted to removably cover an open upper end of the pitcher, wherein the lid comprises a lid sidewall having a lid concave cutout. The lid sidewall is configured to be received within the interior volume of the pitcher such that when the lid is secured to the pitcher, the concave cutout of the pitcher remains uncovered by the lid.

It is yet another objective of the present invention to provide a serving pitcher with an integrated cup holder wherein the pitcher and platform are monolithic structures.

It is therefore an object of the present invention to provide a new and improved a serving pitcher with an integrated cup holder that has all of the advantages of the known art and none of the disadvantages.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings.

DETAILED DESCRIPTION OF THE INVENTION

Reference is made herein to the attached drawings. For the purposes of presenting a brief and clear description of the present invention, the preferred embodiment will be discussed as used for having an integrated cup holder secured to a serving pitcher. The figures are intended for representative purposes only and should not be considered to be limiting in any respect.

Reference will now be made in detail to the exemplary embodiment (s) of the invention. References to "one embodiment," "at least one embodiment," "an embodiment," "one example," "an example," "for example," and so on indicate that the embodiment(s) or example(s) may include a feature, structure, characteristic, property, element, or limitation but that not every embodiment or example necessarily includes that feature, structure, characteristic, property, element, or limitation. Further, repeated use of the phrase "in an embodiment" does not necessarily refer to the same embodiment. Additionally, "pitcher", "serving pitcher", "container", and "beverage container", may be used interchangeably and all refer to the type of container that is configured to hold multiple servings of a liquid. Additionally, "cup", "glass", "individual container", and "vessel" may be used interchangeably, and all refer to the type of device that can receive a liquid and fit within a cup holder of the present invention.

Figure 1:
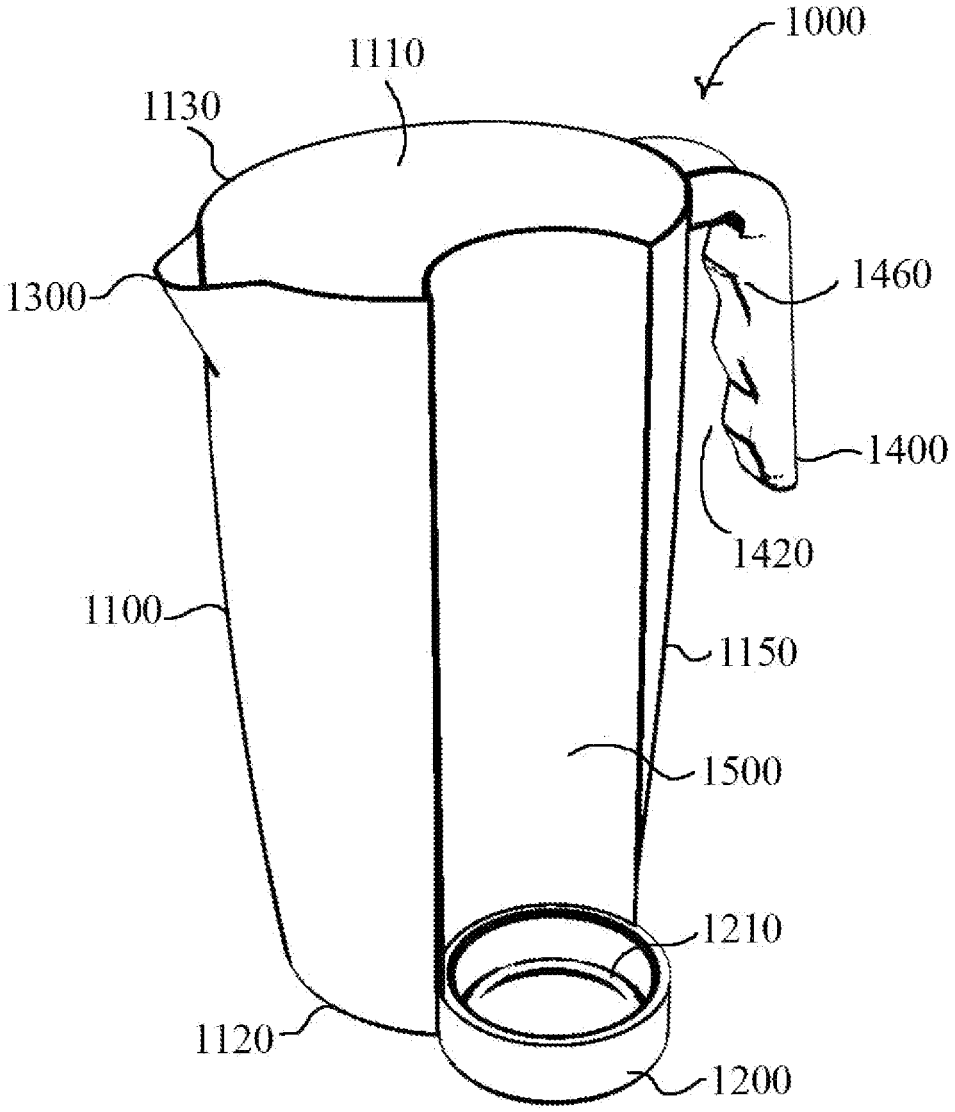
FIG. 1 shows a perspective view of an embodiment of the serving pitcher with an integrated cup holder.
Figure 2:
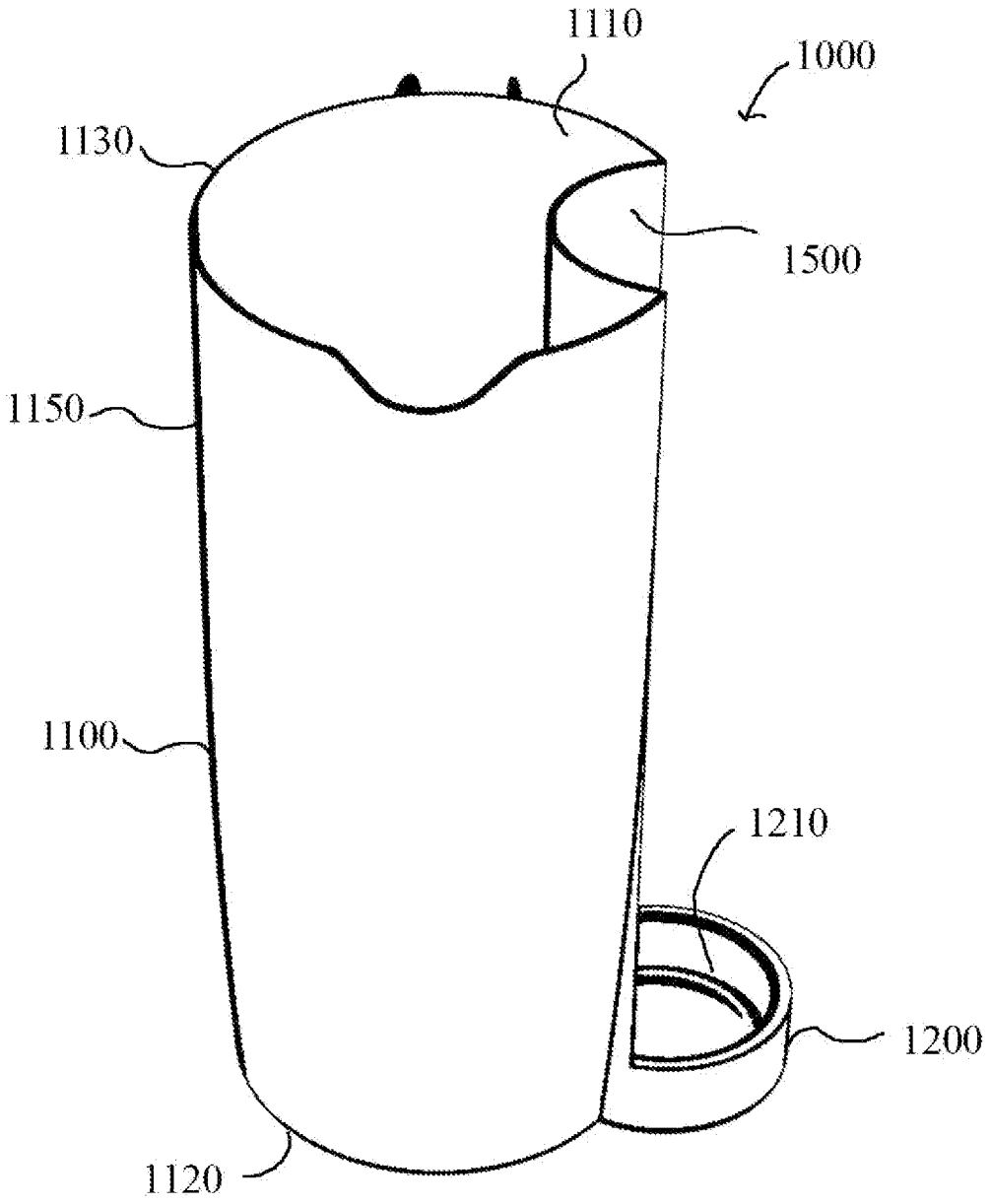
FIG. 2 shows a front perspective view of an embodiment of the serving pitcher with an integrated cup holder.

Referring now to FIGS. 1 and 2, there is shown a perspective view and a front perspective view of an embodiment of the serving pitcher with an integrated cup holder, respectively. The serving pitcher with integrated cup holder 1000 comprises a pitcher 1100 and a platform 1200 extending from the pitcher 1100, wherein the platform 1200 is adapted to support cups in a vertically stacked configuration. The pitcher 1100 comprises an interior volume 1110 configured to retain multiple servings of beverages therein. In the illustrated embodiment, the pitcher 1100 comprises a lower side 1120 forming a base and an opposing upper side 1130 having an open upper end. The open upper end is configured to receive and dispense the liquid therefrom. In the illustrated embodiment, the pitcher 1100 tapers from the upper side 1130 to the lower side 1120, such that the upper side 1130 comprises a larger diameter than the lower side 1120. In alternate embodiments, the pitcher comprises a same diameter at the upper side and the lower side. In other embodiments, the upper side of the pitcher comprises a smaller diameter than the lower side.

In the illustrated embodiment, the pitcher 1100 comprises a spout 1300 at the upper side 1130 thereof, wherein the spout 1300 is configured to dispense the liquid therefrom such that a stream is formed when the beverage is poured. In this way, mess and spillage is prevented while pouring.

In the illustrated embodiment, a handle 1400 extends from an opposing side of the pitcher 1100 from where the spout 1300 extends. The handle 1400 comprises a gap 1420 between the sidewall 1150 of the pitcher 1100 and the handle 1400, such that the gap 1420 is configured to receive a hand of a user therein. In the illustrated embodiment, the handle 1400 comprises a plurality of ridges 1460 on an interior side thereof and configured to provide a finger hold for the user while pouring a beverage from the pitcher 1100. However, in alternate embodiments, the pitcher does not include a handle and a spout. In other embodiments, the pitcher does not include a handle or a spout.

A concave cutout 1500 is formed in a sidewall of the pitcher 1100. In the illustrated embodiment, the cutout 1500 is formed in a lateral sidewall adjacent to and between the spout 1300 and the handle 1400. The cutout 1500 is configured to form to and receive a sidewall of a cup when the cup is disposed on the platform 1200. In the illustrated embodiment, the cutout 1500 extends from the lower side 1120 of the pitcher 1100 to the upper side 1130 of the pitcher 1100. In the illustrated embodiment, the concave cutout 1500 extends to an uppermost end of the pitcher 1100, such that a cross section taken along any horizontal plane of the pitcher 1100 comprises the concave cutout 1500. In some embodiments, the cutout comprises a distance at the widest section thereof that is in close tolerance with a radius of the cup disposed therein. In some embodiments, the cutout extends the entire distance of the sidewall of the pitcher. The cutout 1500 comprises a concave curve so as to coextend with the sidewall of a substantially cylindrical shaped cup. In other embodiments, the cutout comprises any shape that corresponds with the shape of a cup configured to fit therein.

In the illustrated embodiment, the platform 1200 extends from the cutout 1500 at the lower side 1120 of the pitcher 1100, such that when the pitcher 1100 is placed on a flat surface, both the base of the pitcher 1100 and platform 1200 rest flush against the surface. The platform 1200 is partially disposed within the cutout 1500, wherein the remaining portion of the platform 1200 forms an exterior of the pitcher 1100. The platform 1200 provides an upper surface that is adapted to receive a stack of cups thereon. In the illustrated embodiment, the height of the pitcher 1100 is larger than the height of the platform 1200, wherein the height is measured between the lower side 1120 and the upper side 1130 of the pitcher 1100. In the illustrated embodiment, the platform 1200 comprises a circular shaped cross section. In alternate embodiments, the platform comprises any suitable shaped cross section adapted to support a cup thereon. In the illustrated embodiment, the pitcher 1100 and the platform 1200 are monolithic in structure. In other embodiments, the pitcher and platform are formed from separate structures and permanently secured to one another. In some embodiments, the platform is separable from the pitcher to allow the cups to remain on the platform while the pitcher is in a pouring configuration.

The platform 1200 further comprises a securement member adapted to prevent the cups from easily falling from the platform 1200 when the serving pitcher 1100 is in motion. In the illustrated embodiment, the securement member is a recess 1210 configured to receive the cup therein. The recess 1210 provides a sidewall extending entirely around the platform 1200 to prevent the cups from sliding or falling off the platform 1200 during transport. In some embodiments, the platform comprises a vertical wall extending from a side of the platform opposite the cutout, wherein the vertical wall is adapted to retain the cup on the platform such that the cup must be lifted upward to be removed from the platform. In other embodiments, any suitable securement mechanism is used to prevent the cups from sliding off the platform.

Figure 3:
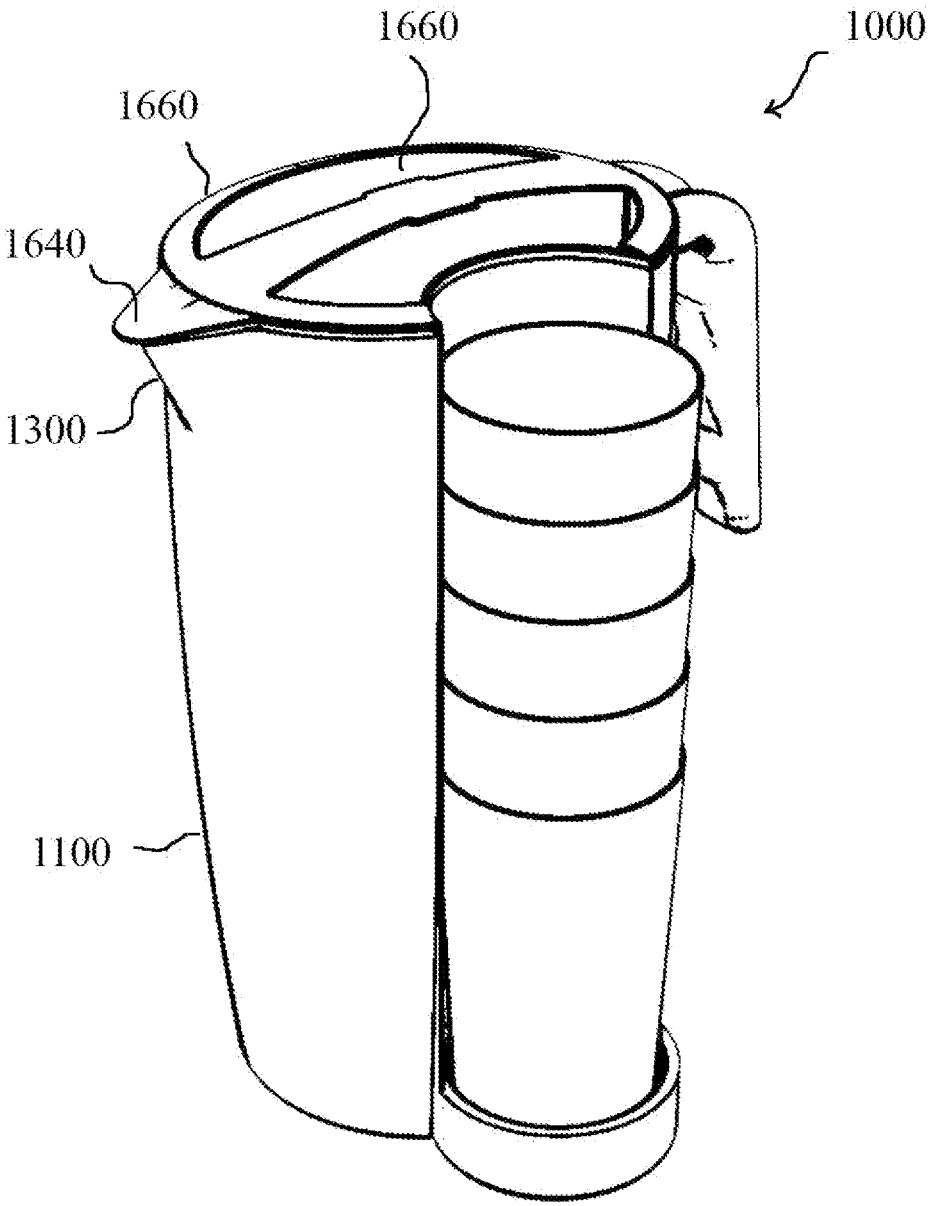
FIG. 3 shows a perspective view of an embodiment of the serving pitcher with an integrated cup holder in use.
Figure 4:
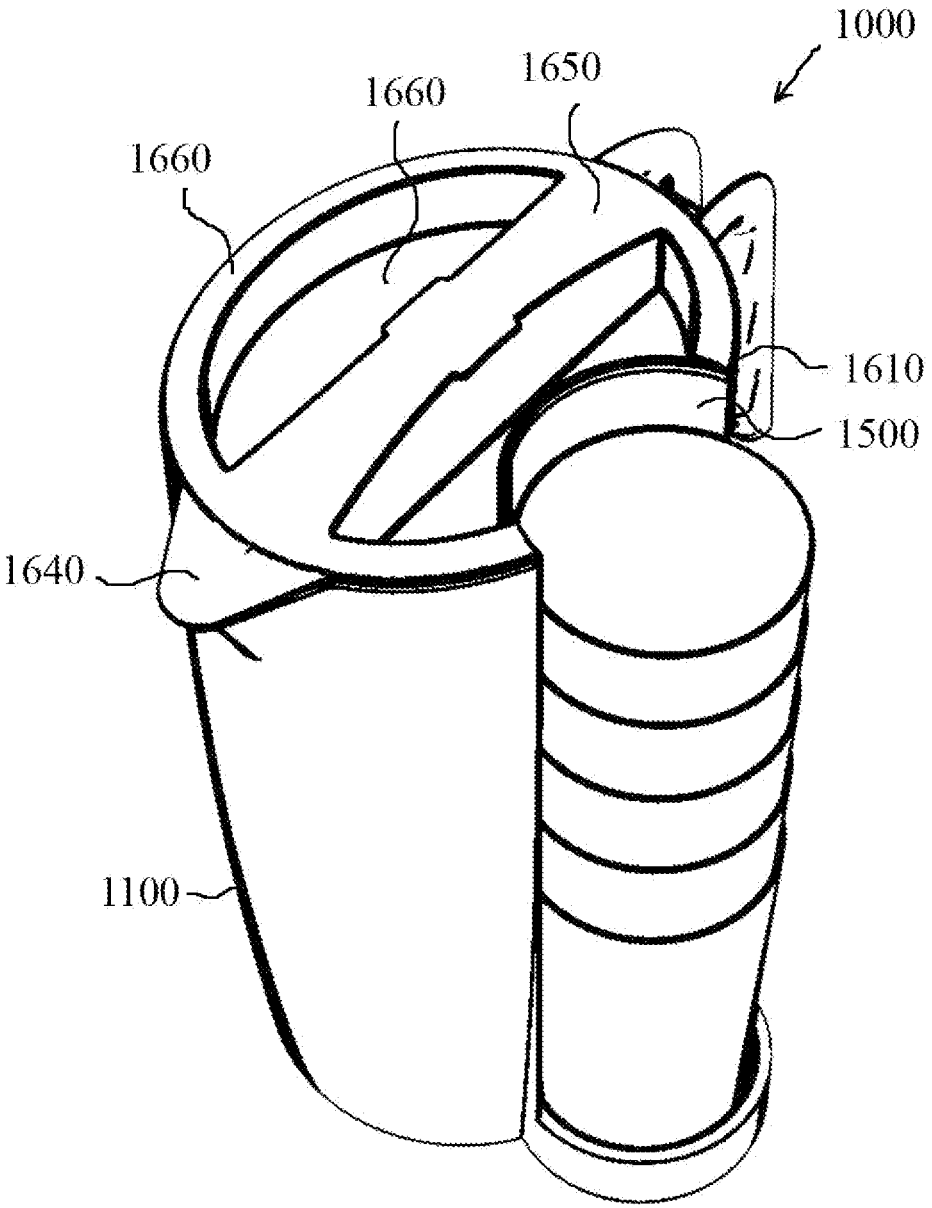
FIG. 4 shows a top perspective view of an embodiment of the serving pitcher with an integrated cup holder in use.
Figure 5:
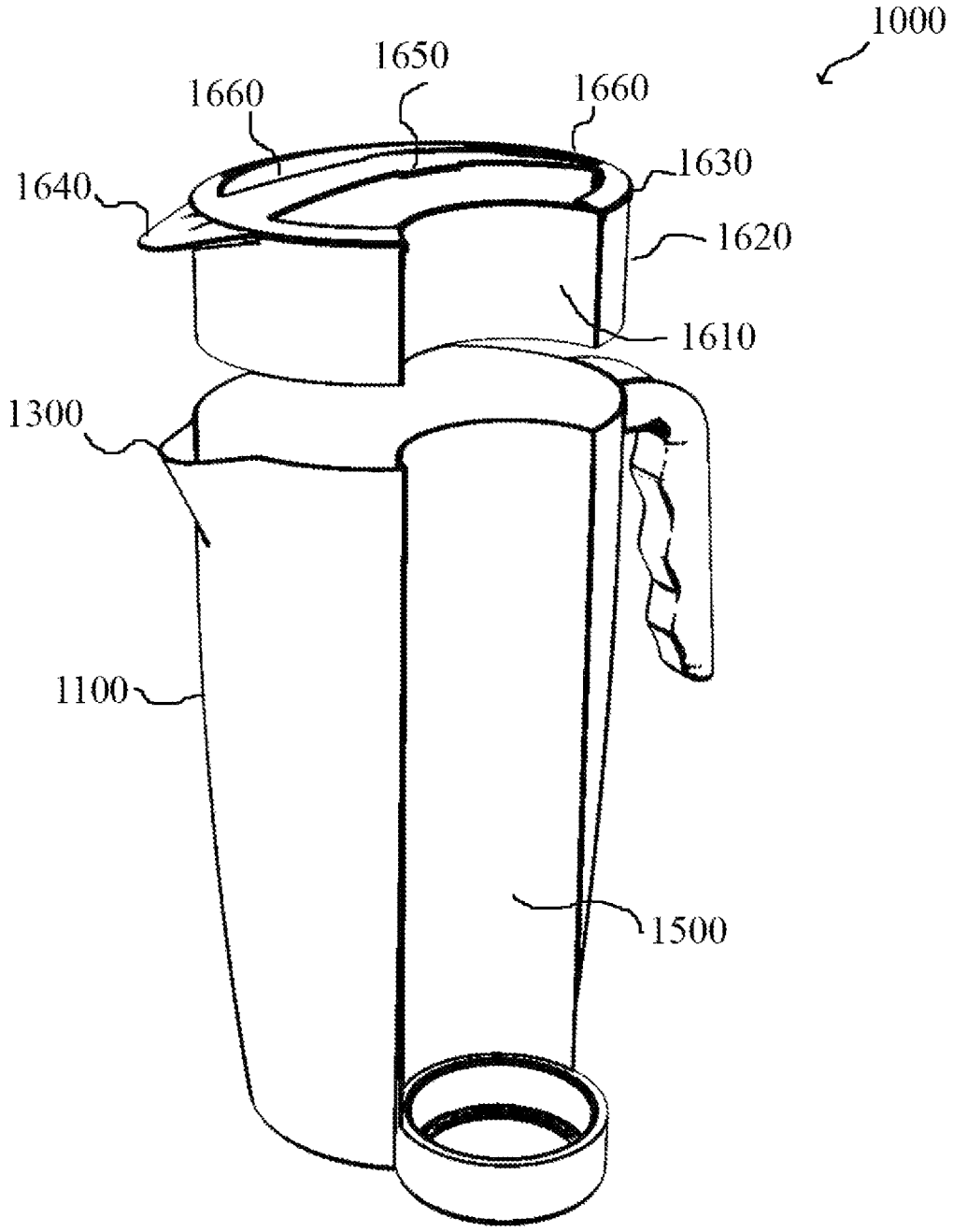
FIG. 5 shows an exploded view of an embodiment of the serving pitcher with an integrated cup holder.

Referring now to FIGS. 3-5, there is shown a perspective view and a top perspective view of an embodiment of the serving pitcher with an integrated cup holder in use, and an exploded view of an embodiment of the serving pitcher with an integrated cup holder, respectively. In some embodiments, the serving pitcher with an integrated cup holder 1000 comprises a lid 1600 adapted to removably cover the open upper end of the pitcher 1100. In the illustrated embodiment, the lid 1600 comprises a lid sidewall 1620 having a lid concave cutout 1610. The lid sidewall 1620 extends downward from a top of the lid 1600 and comprises a smaller perimeter distance than a perimeter distance of the open upper end of the pitcher 1100 such that the lid sidewall 1620 can be received within the interior volume of the pitcher 1100 when the lid 1600 is secured to the pitcher 1100, via a friction fit. The lid cutout 1610 is configured to align with the cutout 1500 of the pitcher 1100, such that when the lid 1600 is secured to the pitcher 1100, the concave cutout 1500 of the pitcher 1100 remains unobstructed and uncovered by the lid 1600.

In the illustrated embodiment, the top of the lid 1600 and the lid sidewall 1620 form a shoulder such that when the lid 1600 is secured to the pitcher 1100, a rim 1630 of the lid 1600 prevents the lid 1600 from falling into the pitcher 1100. A spout cover 1640 extends from the rim 1630 of the lid 1600 and is adapted to align with the spout 1300 to cover the open upper end thereof.

In the illustrated embodiment, the lid 1600 further comprises grip 1650 that extends the length of the lid 1600. The grip 1650 is formed from a cross member disposed between a pair of lid recesses 1660. In this way, a user is able to remove the lid 1600 by placing fingers of a hand on either side of the grip 1650, within the pair of recesses 1660, and applying force to separate the lid 1600 from the pitcher 1100.

Figure 6:
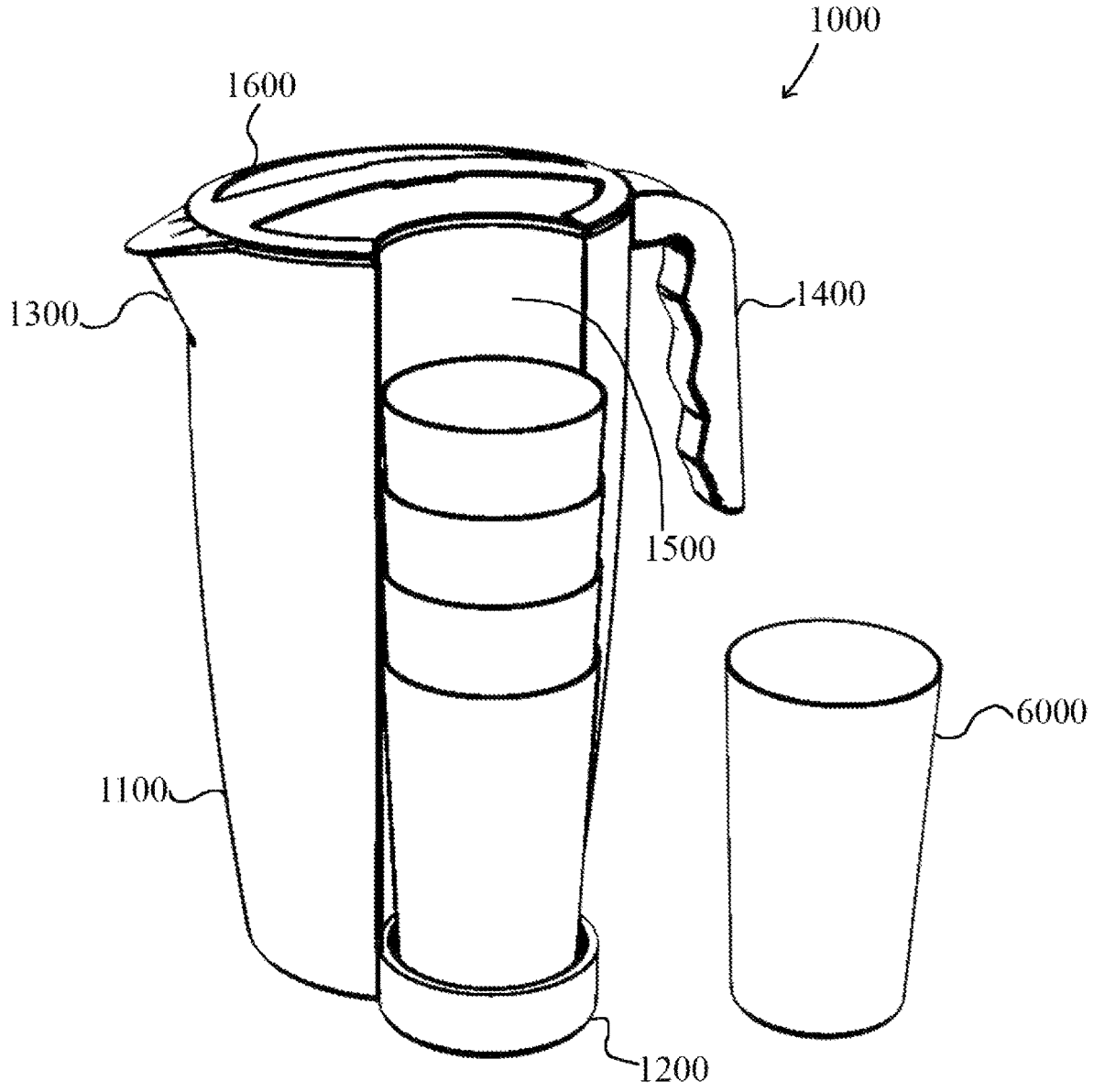
FIG. 6 shows a side perspective view of an embodiment of the serving pitcher with an integrated cup holder in use.

Referring now to FIG. 6, there is shown a side perspective view of an embodiment of the serving pitcher with an integrated cup holder in use. In operation, a plurality of cups 6000 are disposed on the platform 1200, within the recess, of the serving pitcher with an integrated cup holder 1000. The cups 6000 are disposed in a vertically stacked configuration. The plurality of cup 6000 are received by the cutout 1500 such that the cutout 1500 helps support the cups in the stacked configuration. In some embodiments, the cups are frictionally engaged with the sidewall of the cutout. The platform 1200 allows the cups 6000 to be transported along with the pitcher 1100. As a beverage is being poured into a cup, the remaining stack of cups can be removed from the platform or, in some embodiments, remain on the platform 1200 due to the frictional engagement of the cups with the cutout 1500. A user can remove the lid 1600 and grasp the pitcher 1100 by the handle 1400 to pout the beverage from the spout 1300.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A serving pitcher with integrated cup holder, comprising:

the pitcher having an interior volume configured to retain liquid therein;

a cutout formed in a sidewall of the pitcher, wherein the cutout forms a concave shape and extends from a lower side of the pitcher to an opposing upper side of the pitcher;

a platform extending into the cutout at the lower side of the pitcher, wherein the platform has an upper side that is adapted to receive a cup therein such that the received cup is partially positioned within the cutout; wherein a height of the pitcher is greater than a height of the platform, the height of the pitcher being measured between the lower side and the upper side of the pitcher;

wherein the pitcher tapers from the upper side to the lower side;

a lid adapted to removably cover an open upper end of the pitcher; and wherein the lid comprises a lid sidewall having a concave lid cutout, the lid sidewall adapted to be received within the interior volume of the pitcher such that when the lid is secured to the pitcher, the cutout of the pitcher remains uncovered by the lid.

* * * * *